US010343832B2

(12) United States Patent
Godet

(10) Patent No.: US 10,343,832 B2
(45) Date of Patent: Jul. 9, 2019

(54) CONTAINER PROVIDED WITH A CONVEX INVERTIBLE DIAPHRAGM

(71) Applicant: SIDEL PARTICIPATIONS, Octeville-sur-Mer (FR)

(72) Inventor: Florian Godet, Octeville-sur-Mer (FR)

(73) Assignee: SIDEL PARTICIPATIONS, Octeville-sur-Mer (FR)

( * ) Notice: Subject to any disclaimer, the term of this patent is extended or adjusted under 35 U.S.C. 154(b) by 0 days.

(21) Appl. No.: 15/625,440

(22) Filed: Jun. 16, 2017

(65) Prior Publication Data

US 2017/0362009 A1 Dec. 21, 2017

(30) Foreign Application Priority Data

Jun. 17, 2016 (EP) ..... 16305738

(51) Int. Cl.
*B65D 79/00* (2006.01)
*B65D 1/02* (2006.01)

(52) U.S. Cl.
CPC ..... *B65D 79/005* (2013.01); *B65D 1/0246* (2013.01); *B65D 1/0276* (2013.01); *B65D 1/0284* (2013.01)

(58) Field of Classification Search
CPC .. B65D 79/005; B65D 1/0276; B65D 1/0246; B65D 1/0284; B65D 81/3837; B65D 25/00; B65D 25/005
USPC ..... 220/608, 623, 669, 676, 670; 215/373, 215/370–372, 378, 382, 385
See application file for complete search history.

(56) References Cited

U.S. PATENT DOCUMENTS 8,870,006 B2 * 10/2014 Kamineni ..... B65D 1/0223 215/381
2003/0230545 A1 * 12/2003 Mount ..... B65D 1/023 215/42
2004/0195199 A1 * 10/2004 Maki ..... B65D 1/0223 215/381
2007/0187355 A1 * 8/2007 Kamineni ..... B65D 1/0223 215/384
2008/0011706 A1 * 1/2008 Downing ..... B65D 1/0246 215/256
2008/0047964 A1 2/2008 Denner et al.
2010/0032405 A1 * 2/2010 Ozawa ..... B65D 1/0223 215/383

FOREIGN PATENT DOCUMENTS

EP 2 957 522 A1 12/2015

* cited by examiner

*Primary Examiner* — Kareen K Thomas
(74) *Attorney, Agent, or Firm* — Young & Thompson

(57) ABSTRACT

Disclosed is a container, made of plastic material, and provided with a base including a standing ring forming a support flange, an inner wall, a diaphragm and a central portion, the diaphragm being capable of standing in an outwardly-inclined position. The diaphragm connects to the standing ring at an outer junction, and connects to the central portion at an inner junction. The diaphragm is invertible with respect to the standing ring from the outwardly-inclined position to an inwardly-inclined position. In the outwardly-inclined position, the whole diaphragm is curved in radial section, with a concavity turned inwards with respect to the container. The diaphragm has a depth strictly greater than 1 mm.

20 Claims, 2 Drawing Sheets

CONTAINER PROVIDED WITH A CONVEX INVERTIBLE DIAPHRAGM

FIELD OF THE INVENTION

The invention generally relates to the manufacturing of containers, such as bottles, which are produced by blow molding or stretch-blow molding from preforms made of plastic (mostly thermoplastic, e.g. PET) material. More specifically but not exclusively, the invention relates to the processing of hot-fillable containers, i.e. containers filled with a hot pourable product (typically a liquid), the term "hot" meaning that the temperature of the product is close to or above the glass transition temperature of the material in which the container is made. Typically, hot filling of PET containers (the glass transition temperature of which is of about 80° C.) is conducted with products at a temperature comprised between about 85° C. and about 100° C., typically at 90° C.

BACKGROUND OF THE INVENTION

U.S. Pat. Appl. No. 2008/0047964 (Denner et al, assigned to CO2PAC) discloses a container comprising a pressure panel located in the bottom portion of the container.

According to Denner, the pressure panel is movable between an outwardly-inclined position and an inwardly-inclined position to compensate for a change of pressure inside the container. In order to alleviate all or a portion of the vacuum forces within the container, the pressure panel is moved from the outwardly-inclined position by a mechanical pusher after the container has been capped and cooled, in order to force the pressure panel into the inwardly-inclined position.

Tests conducted on such a container showed that, once inverted to the inwardly-inclined position, the pressure panel does not maintain its position but tends to sink back under the pressure of the content. In the end, after the content has cooled, the container has lost much rigidity and therefore feels soft when held in hand. When stacking or palletizing the containers, there is a risk for the lower containers to bend under the weight of upper containers, and hence a risk for the whole pallet to collapse.

This design was enhanced by European Pat. Appl. No. EP 2 957 522 (Sidel Participations), which proposes a container including an invertible diaphragm having an inwardly-inclined position, wherein it has an inner portion, with a concavity turned outwards with respect to the container, and an outer portion, with a concavity turned inwards with respect to the container.

In order to achieve this configuration, in an outwardly-inclined position the diaphragm is curved in radial section with a concavity turned outwards with respect to the container. It is forced inwards by means of a mechanical pusher.

Although this design is better than Denner's for it provides more rigidity to the container, it still needs to be enhanced since, in some cases, the diaphragm cannot withstand the pressure inside the container and collapses back to its outwardly-inclined position.

Tests conducted with the container at least partly explain this behavior:

- the extraction volume (i.e. the volume swept by the diaphragm between its outwardly-inclined and its inwardly-inclined position) is insufficient;
- weakness of the diaphragm leading to its collapse seems to be located at the junction between the inner portion and the outer portion;

- the shape of the diaphragm makes it difficult to achieve inversion and hence to reach the inwardly-inclined position when the filling level of the container is high or the filling product too hot.

SUMMARY OF THE INVENTION

It is an object of the invention to propose a container provided with an invertible diaphragm, which container has a greater mechanical rigidity than the known containers after the diaphragm has been inverted and placed in its inwardly-inclined position, and hence a better stability when stacked.

It is another object of the invention to propose a container provided with an invertible diaphragm capable of maintaining its inwardly-inclined position.

It is therefore provided a container made of a plastic material, extending along a main axis and provided with a base including a standing ring forming a support flange and an inclined inner wall, said base further including a diaphragm extending from the inner wall to a central portion, said diaphragm being capable of standing in an outwardly-inclined position, wherein the diaphragm connects to the inner wall at an outer junction forming an outer articulation of the diaphragm with respect to the inner wall;

wherein the diaphragm connects to the central portion at an inner junction forming an inner articulation of the diaphragm with respect to the central portion;

whereby said diaphragm is invertible with respect to the standing ring from the outwardly-inclined position, in which the inner junction extends below the outer junction, to an inwardly-inclined position, in which the inner junction extends above the outer junction;

wherein:

- in the outwardly-inclined position, the whole diaphragm is curved in radial section, with a concavity turned inwards with respect to the container,
- the diaphragm has a crest and a depth measured, in radial section, between the crest and a straight line joining the inner junction to the outer junction, which is strictly greater than 1 mm.

This container offers a better mechanical strength when stressed. In particular, the inverted diaphragm is more resistant to high pressures within the container.

According to various embodiments, taken either separately or in combination:

- the inner wall is curved in radial section, with a concavity turned towards the main axis.
- the depth of the diaphragm is comprised between 1.5 mm and 5 mm.
- the depth of the diaphragm is of about 2.5 mm.
- in radial section, a straight line joining the inner junction to the outer junction in the outwardly-inclined position is inclined, with respect to a line perpendicular to the main axis, by an angle comprised between 20° and 40°, and preferably of about 35°.
- In radial section, a straight line joining the support flange and the outer junction is inclined inwardly, with respect to a direction parallel to the main axis, by an angle comprised between 10° and 25°, and preferably of about 20°.
- the diaphragm has an outer diameter, measured at the outer junction, and an inner diameter, measured at the inner junction, such that their ratio is comprised between about 0.3 and about 0.7, and preferably of about 0.4.

the diaphragm has an outer diameter, measured at the outer junction, which is comprised between 50% and 80%, and preferably of about 68%, of a base diameter of the container.

the diaphragm has an inner diameter, measured at the inner junction, which is comprised between 25% and 35%, and preferably of about 28%, of a base diameter of the container.

a clearance between the support flange and a laying plane, by which the container is to be held on a planar surface, is comprised between 1 mm and 5 mm, and preferably of about 3.5 mm.

The above and other objects and advantages of the invention will become apparent from the detailed description of preferred embodiments, considered in conjunction with the accompanying drawings.

DETAILED DESCRIPTION

Figure 1:
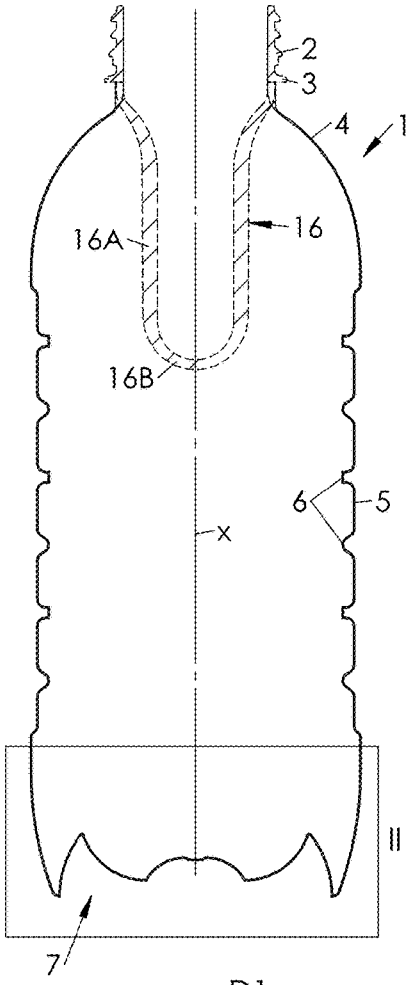
FIG. 1 is a sectional view showing both a preform (in dotted line) and a resulting container formed therefrom, with a diaphragm at its base in the outwardly-inclined position.

FIG. 1 shows a container 1 suitable for being filled with a product, preferably liquid (such as tea, fruit juice, or a sports drink).

The container 1 includes an upper open upper portion or neck 2, which terminates, at a lower end thereof, in a collar 3 of greater diameter. The neck 2 is cylindrical and adapted to receive a cap (not shown). For it, the neck 2 can be threaded, as illustrated, to receive a threaded cap, or it can be shaped to receive a cork closure or similar. Below the collar 3, the container 1 includes a shoulder 4, which connects to the collar 3 through a cylindrical upper end portion of short length.

Below the shoulder 4, the container 1 has a wall portion 5, which is substantially cylindrical around a container main axis X. The wall portion 5 may, as depicted on FIG. 1, include annular stiffening ribs 6 capable of resisting stresses, which would otherwise tend to make the wall portion 5 oval when viewed in a horizontal section (such a deformation is standard and called ovalization).

At a lower end of the wall portion 5, the container 1 has a base 7, which closes the container 1 and allows it to be put on a planar surface such as a table.

The container base 7 includes a standing ring 8 including an outer wall 9, which blends with the wall portion 5, and an inner wall 10. The standing ring 8 ends with a support flange 11, which joins the outer wall 9 and the inner wall 10. The support flange 11 preferably has, in radial section, a width, denoted W. The support flange 11 preferably extends in a laying plane P, which is substantially perpendicular to the main axis X.

The container base 7 further includes a central portion 12 and a diaphragm 13 extending from the standing ring 8 to the central portion 12. In the depicted example, the central portion 12 is shaped as a dome with a concavity turned outwards with respect to the container 1.

The container base 7 has a outer diameter denoted D1 at its junction with the bottle body.

The diaphragm 13 connects to the standing ring 8 (and more precisely to the inner wall 10) at an outer junction 14 and to the central portion 12 at an inner junction 15. Both the outer junction 14 and the inner junction 15 are preferably curved (or rounded). The diaphragm 13 has an outer diameter D2, measured at the outer junction 14, and an inner diameter D3, measured at the inner junction 15.

The container 1 is blow-molded from a preform 16 (in dotted line on FIG. 1) including the unchanged neck 2, a cylindrical wall 16A and a rounded bottom 16B.

The container 1 is blow-molded with the diaphragm 13 standing in an outwardly-inclined position, in which the inner junction 15 is located below the outer junction 14 (the container 1 being held normally neck up), FIG. 1 and FIG. 2.

Figure 3:
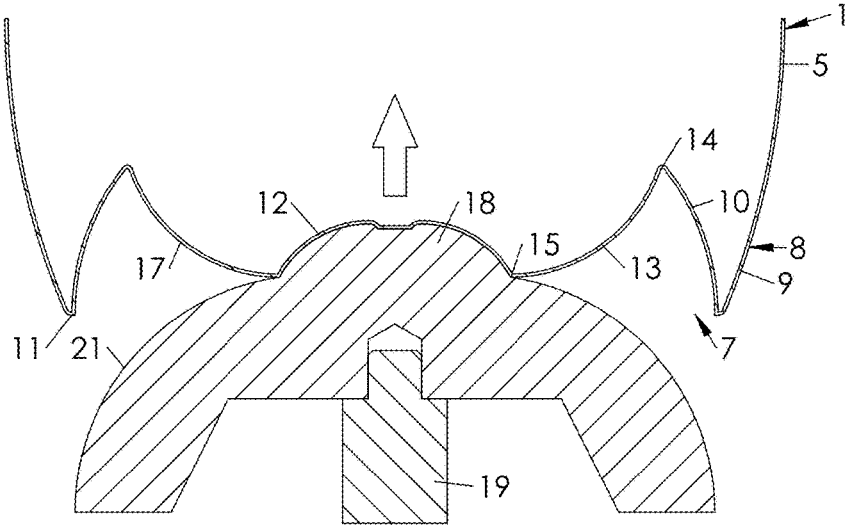
FIG. 3 is an enlarged sectional view similar to FIG. 2, showing the base of the container with its diaphragm in the outwardly-inclined position, together with a pusher moving upwards to invert the diaphragm.
Figure 4:
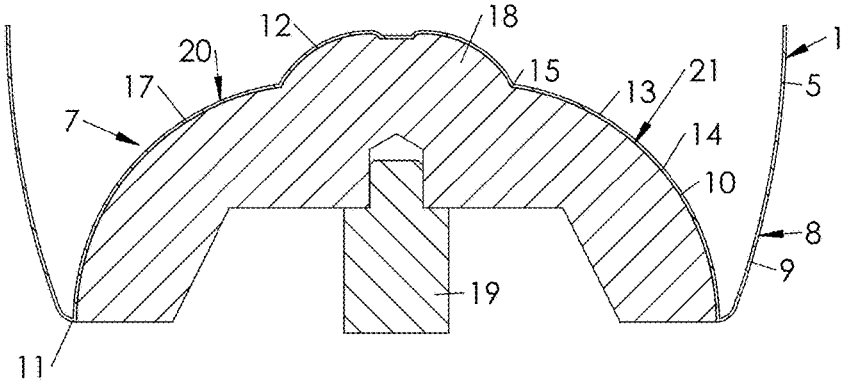
FIG. 4 is an enlarged sectional view similar to FIG. 3, showing the base of the container with its diaphragm inverted by the pusher.
Figure 5:
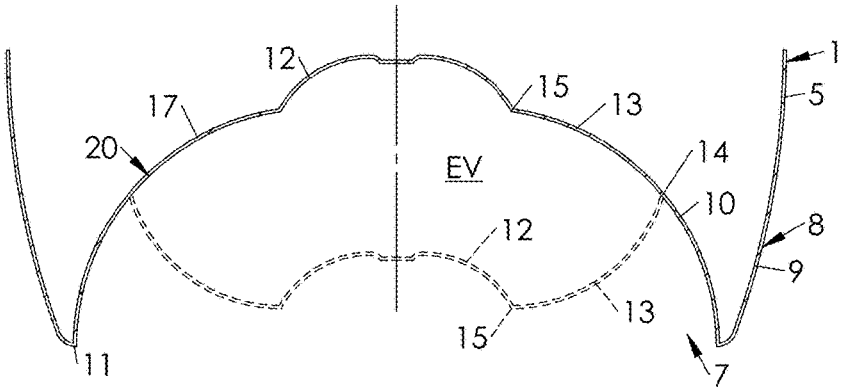
FIG. 5 is an enlarged sectional view showing the base of the container with its diaphragm both in the inwardly-inclined position (in continuous line) and in the outwardly-inclined position (in dotted line).

The outer junction 14 forms an outer articulation of the diaphragm 13 with respect to the standing ring 8 (and more precisely the inner wall 10) and the inner junction 15 forms an inner articulation of the diaphragm 13 with respect to the central portion 12, whereby the diaphragm 13 is invertible with respect to the standing ring 8 from the outwardly-inclined position (in continuous line on FIG. 2 and FIG. 3 and in dotted lines on FIG. 5) to an inwardly-inclined position wherein the inner junction 15 is located above the outer junction 14 (in continuous lines on FIG. 4 and FIG. 5).

Figure 2:
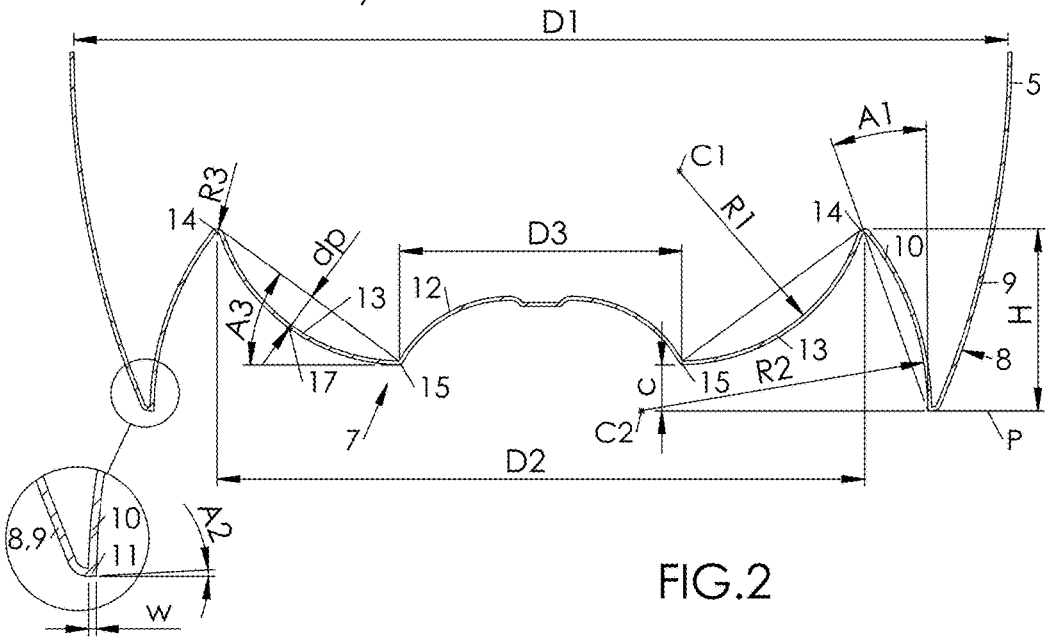
FIG. 2 is an enlarged sectional view showing the base of the container within the frame II of FIG. 1.

In the outwardly-inclined position, the inner junction 15 is located above the laying plane P (i.e. offset the laying plane P inwardly with respect to the container 1) by a clearance denoted C (shown on FIG. 2)

As depicted on the drawings, and more specifically on FIG. 2, in the outwardly-inclined position, the whole diaphragm 13 is curved in radial section with a concavity turned inwards with respect to the container 1.

More precisely, the diaphragm 13 has a radius of curvature denoted R1.

In a preferred embodiment depicted on the drawings, the diaphragm 13 has a center of curvature, denoted C1, which, in the outwardly-inclined position, is located axially on a vertical line (i.e. parallel to the main axis X) passing through the inner junction 15. In other words, in the outwardly-inclined position, the tangent to the diaphragm 13 at the inner junction 15 is horizontal, i.e. perpendicular to the main axis X.

In a preferred embodiment depicted on the drawings, the standing ring 8 is a high standing ring, i.e. inner wall 10 has a height H, measured axially (i.e. in a direction parallel to main axis X) between the laying plane P and the outer junction 14, which is not negligible with respect to the outer diameter D1. The expression "not negligible" means that the height H of the inner wall 10 is greater than 15% of the outer diameter D1.

In a preferred embodiment, and as depicted on the drawings, the inner wall 10 is curved in radial section, with a concavity turned towards the main axis. The inner wall 10 has a radius of curvature denoted R2.

In a preferred embodiment depicted on the drawings, the inner wall 10 has a center of curvature, denoted C2, located on the laying plane P. In other words, the tangent to the inner wall 10 at the support flange 11 is vertical, i.e. parallel to the main axis X.

In addition, the inner wall 10 is preferably inclined inwardly, in such a way that, in radial section, a straight line joining the support flange 11 and the outer junction 15 is inclined inwardly, with respect to a direction parallel to the main axis X, by an angle denoted A1.

In the depicted preferred embodiment, the support flange 11 is inclined with respect of a horizontal plane (i.e. a plane perpendicular to the main axis X) by a small angle denoted A2.

As depicted on the drawings, the diaphragm 13 is such configured that, in radial section, a straight line joining the inner junction 15 to the outer junction 14 in the outwardly-inclined position is inclined, with respect to a horizontal line (i.e. perpendicular to the main axis X), by an angle denoted A3.

The diaphragm 13 has a crest 17 and a depth, denoted dp, which is the distance measured in radial section between the crest 17 and the straight line joining the inner junction 15 to the outer junction 14.

The outer junction 14 may be sharp but it is preferably rounded. In this case, it has a radius of curvature, denoted R3.

In a preferred embodiment, and as depicted on FIG. 3 and FIG. 4, inversion of the diaphragm 13 is achieved mechanically by means of a pusher 18 mounted on a jack 19, after the container 1 has been filled with a product, capped and cooled down, in order to compensate for the vacuum generated by the cooling of the product or to increase its internal pressure, and to provide rigidity to the wall portion 5.

As depicted on FIG. 5, inversion of the diaphragm 13 provokes a liquid displacement of a volume (and a corresponding decrease of the inner volume of the container 1), which is denoted EV and called "extraction volume". The extraction volume EV is comprised between the outwardly-inclined position of the diaphragm 13 and the inwardly-inclined position of the diaphragm 13.

In a preferred embodiment, and as depicted on FIG. 4 and FIG. 5, the diaphragm 13 has, in the inwardly-inclined position, a curved shape in radial section, with a concavity turned outwards with respect to the container 1.

As the inner wall 10 is curved too, the diaphragm 13 and the inner wall 10 together form an arched vault 20, which is capable of withstanding a high pressure from the content of the container 1 without inverting back. Pressure within the container 1 is thereby maintained to a high value. The container 1 feels rigid when held in hand. In addition, the container 1 provides, when palletized, stability to the pallet.

Parameters D1, D2, D3, R1, R2, R3, A1, A2, A3, W, C, H, D are chosen, either separately or in combination, to enhance the mechanical performance of the base 7 in the inwardly-inclined position and more specifically to increase stability of the vault 20.

Setting the outer diameter D2 and inner diameter D3 with respect to each other or to the base diameter D1 serves to adjust the extraction volume EV and thereby to control the pressure in the container in the inwardly-inclined position.

Decreasing the inner diameter D3 with respect to the outer diameter D2 decreases the extraction volume EV and hence limits the pressure in the container 1 in the inwardly-inclined position.

On the contrary, increasing the inner diameter D3 of the diaphragm 13 with respect to the outer diameter D2 increases the extraction volume EV and hence maximize the pressure in the container 1 in the inwardly-inclined position.

However, D2 being too large would result in a weakness with diaphragm 13 stability, as it reduces angle A3.

A good compromise between pressure in the container 1 and strength of the stability of the diaphragm 13 of the container base 7 is achieved when D2 and D3 are such that their ratio is comprised between about 0.3 and 0.7:

$$0.3 \cdot D2 \leq D3 \leq 0.7 \cdot D2$$

Ratio of D3 and D2 is preferably of about 0.4:

$$D3 \cong 0.4 \cdot D2$$

As already said, outer diameter D2 and inner diameter D3 may be chosen with respect to D1.

Outer diameter D2 is preferably comprised between 50% and 80% of D1:

$$0.5 \cdot D1 \leq D2 \leq 0.8 \cdot D1$$

More preferably, outer diameter D2 is of about 68% of D1:

$$D2 \cong 0.68 \cdot D1$$

Inner diameter D3 is preferably comprised between 25% and 35% of D1:

$$0.25 \cdot D1 \leq D3 \leq 0.35 \cdot D1$$

More preferably, inner diameter D3 is of about 28% of D1:

$$D3 \cong 0.28 \cdot D1$$

The radius R1 is not necessarily to be set at a predetermined value: it may be regarded as a result of the setting of diameters D2 and D3, angle A3 and depth dp.

The setting of diameters D2 and D3 has already been disclosed.

Angle A3 is preferably comprised between 20° and 40°:

$$20° \leq A3 \leq 40°$$

In the depicted example, angle A3 is of about 35°:

$$A3 \cong 35°$$

Proper setting of the depth dp ensures proper inversion of the diaphragm 13 and increases the pressure that may be held by the diaphragm 13 in the inwardly-inclined position. Increasing depth dp increases the extraction volume EV. However, a depth dp set too high may result in the diaphragm 13 being difficult to invert.

Depth dp is therefore preferably comprised between 1.5 mm and 3.5 mm:

$$1.5 \text{ mm} \leq dp \leq 3.5 \text{ mm}$$

More preferably, depth dp is of about 2.5 mm:

$$dp \cong 2.5 \text{ mm}$$

Clearance C is preferably comprised between 1 mm and 5 mm:

$$1 \text{ mm} \leq C \leq 5 \text{ mm}$$

More preferably, clearance C is of about 3.5 mm:

$$C \cong 3.5 \text{ mm}$$

Setting angle A1 acts upon the shape of the vault 20, in combination with R1 (which is set as a consequence of the setting of D2, D3, A3 and D) and A3. Parameters, and A1 in particular, should be set such that the vault 20 is substantially continuous, and smooth at the outer junction 14, as depicted on FIG. 5.

Angle A1 is preferably comprised between 10° and 25°:

$$10° \leq A1 \leq 25°$$

In a preferred embodiment depicted on the drawings (see FIG. 2), angle A1 is of about 20°:

$$A1 \cong 20°$$

Angle A2 contributes to provide flexibility to the inner wall 10 during inversion of the diaphragm 13. As already stated, angle A2 is "small", which means that A2 is lower than or equal to 5°:

$$A2 \leq 5°$$

Angle A2 is more preferably of about 3°:

$$A2 \cong 3°$$

The support flange 11 provides stability and effort distribution to the container 1 when standing on a planar surface. Width W of the support flange 11 is preferably comprised between 0.7 mm and 3 mm:

$$0.7 \text{ mm} \leq W \leq 3 \text{ mm}$$

As already stated, height H of the inner wall 10 is greater than 15% of the base diameter D1. More preferably, height H is comprised between 10 mm and 17 mm:

$$10 \text{ mm} \leq H \leq 17 \text{ mm}$$

and, preferably, H is of about 14 mm:

$$H \cong 14 \text{ mm}$$

The so configured container base 7 provides better mechanical performance and, more precisely, better stiffness (i.e. mechanical resistance) under pressure. More specifically, as already stated, the initially convex diaphragm 13 inverts to a concave configuration, where it forms, with the inner wall 10, the vault 20, which is smooth and, as in the depicted example, has a spherical shape. This spherical shape is the best one, which allows to resist pressure inside container 1 and hence prevent the vault 20 to collapse back to the outwardly-inclined position of the diaphragm 13.

In order to facilitate inversion of the diaphragm 13, the pusher 18 preferably has a front surface 21, the shape of which substantially corresponds at least to the diaphragm 13 in its inverted position, and preferably to the whole vault 20, as depicted on FIG. 4.

The invention claimed is:

1. A container (1) made of a plastic material and extending along a main axis (X), comprising:

a base (7) including a standing ring (8) ending with a support flange (11) and an inclined inner wall (10), said base (7) further including a diaphragm (13) extending from the inner wall (10) to a central portion (12), said diaphragm (13) being capable of standing in an outwardly-inclined position, wherein the diaphragm (13) connects to the inner wall (10) at an outer junction (14) forming an outer articulation of the diaphragm (13) with respect to the inner wall (10), wherein the diaphragm (13) connects to the central portion (12) at an inner junction (15) forming an inner articulation of the diaphragm (13) with respect to the central portion (12), whereby said diaphragm (13) is invertible with respect to the standing ring (8) from the outwardly-inclined position, in which the inner junction (15) extends below the outer junction (14), to an inwardly-inclined position, in which the inner junction (15) extends above the outer junction (14), and wherein:

in the outwardly-inclined position, the whole diaphragm (13) is curved in radial section, with a concavity turned inwards with respect to the container (1), and the diaphragm (13) has a crest (17) and a depth (dp) measured, in radial section, between the crest (17) and a straight line joining the inner junction (15) to the outer junction (14), which is strictly greater than 1 mm.

2. The container (1) according to claim 1, wherein the inner wall (10) is curved in radial section, with a concavity turned towards the main axis (X).

3. The container (1) according to claim 1, wherein the depth (dp) of the diaphragm (13) is comprised between 1.5 mm and 5 mm.

4. The container (1) according to claim 3, wherein the depth (dp) of the diaphragm (13) is of about 2.5 mm.

5. The container (1) according to claim 1, wherein, in radial section, a straight line joining the inner junction (15) to the outer junction (14) in the outwardly-inclined position is inclined, with respect to a line perpendicular to the main axis (X), by an angle (A3) comprised between 20° and 40°.

6. The container (1) according to claim 5, wherein said angle (A3) is of about 35°.

7. The container (1) according to claim 1, wherein, in radial section, a straight line joining the support flange (11) and the outer junction (14) is inclined inwardly, with respect to a direction parallel to the main axis X, by an angle (A1) comprised between 10° and 25°.

8. The container (1) according to claim 7, wherein said angle (A1) is of about 20°.

9. The container (1) according to claim 1, wherein the diaphragm (13) has an outer diameter (D2), measured at the outer junction (14), and an inner diameter (D3), measured at the inner junction (15), such that their ratio (D3/D2) is comprised between about 0.3 and about 0.7.

10. The container (1) according to claim 9, wherein the outer diameter (D2) and the inner diameter (D3) of the diaphragm (13) are such that their ratio (D3/D2) is of about 0.4.

11. The container (1) according to claim 1, wherein the diaphragm (13) has an outer diameter (D2), measured at the outer junction (14), which is comprised between 50% and 80% of a base diameter (D1) of the container (1).

12. The container (1) according to claim 11, wherein the outer diameter (D2) is of about 68% of D1.

13. The container (1) according to claim 1, wherein the diaphragm (13) has an inner diameter (D3), measured at the inner junction (15), which is comprised between 25° and 35% of a base diameter (D1) of the container (1).

14. The container (1) according to claim 13, wherein the inner diameter (D3) is of about 28% of the base diameter (D1) of the container (1).

15. The container (1) according to claim 1, wherein a clearance (C) between the support flange (11) and a laying plane (P), by which the container (1) is to be held on a planar surface is comprised between 1 mm and 5 mm.

16. The container (1) according to claim 2, wherein the depth (dp) of the diaphragm (13) is comprised between 1.5 mm and 5 mm.

17. The container (1) according to claim 2, wherein, in radial section, a straight line joining the inner junction (15) to the outer junction (14) in the outwardly-inclined position is inclined, with respect to a line perpendicular to the main axis (X), by an angle (A3) comprised between 20° and 40°.

18. The container (1) according to claim 3, wherein, in radial section, a straight line joining the inner junction (15) to the outer junction (14) in the outwardly-inclined position is inclined, with respect to a line perpendicular to the main axis (X), by an angle (A3) comprised between 20° and 40°.

19. The container (1) according to claim 4, wherein, in radial section, a straight line joining the inner junction (15) to the outer junction (14) in the outwardly-inclined position is inclined, with respect to a line perpendicular to the main axis (X), by an angle (A3) comprised between 20° and 40°.

20. The container (1) according to claim 1, wherein a clearance (C) between the support flange (11) and a laying plane (P), by which the container (1) is to be held on a planar surface is about 3.5 mm.

* * * * *